US008391732B2

(12) United States Patent
Honjoh et al.

(10) Patent No.: US 8,391,732 B2
(45) Date of Patent: Mar. 5, 2013

(54) IMAGE FORMING DEVICE

(75) Inventors: Kenji Honjoh, Kanagawa (JP); Fumihito Itoh, Kanagawa (JP); Masahiko Shakuto, Kanagawa (JP); Kaoru Yoshino, Tokyo (JP); Takuma Iwasaki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 273 days.

(21) Appl. No.: 12/805,531

(22) Filed: Aug. 4, 2010

(65) Prior Publication Data

US 2011/0052225 A1 Mar. 3, 2011

(30) Foreign Application Priority Data

Aug. 28, 2009 (JP) ..... 2009-198830

(51) Int. Cl.
*G03G 21/12* (2006.01)

(52) U.S. Cl. ..... 399/35; 399/359; 399/360

(58) Field of Classification Search ..... 399/35, 399/120, 358, 360
See application file for complete search history.

(56) References Cited

U.S. PATENT DOCUMENTS

2006/0120779 A1* 6/2006 Uchihashi ..... 399/358
2007/0209877 A1 9/2007 Arai et al.
2009/0185842 A1 7/2009 Hatori et al.
2009/0252510 A1 10/2009 Shintani et al.
2010/0183349 A1 7/2010 Shintani et al.

FOREIGN PATENT DOCUMENTS

JP 3183733 4/2001
JP 2002-214984 7/2002
JP 2005-257813 9/2005

OTHER PUBLICATIONS

Abstract of JP 06-13333 published Jun. 7, 1994.

* cited by examiner

*Primary Examiner* — Walter L Lindsay, Jr.
*Assistant Examiner* — Barnabas Fekete
(74) *Attorney, Agent, or Firm* — Harness, Dickey & Pierce, P.L.C.

(57) ABSTRACT

An image forming device includes: a collecting container that collects a waste toner; a rotation member that rotates and spreads a waste toner inside the collecting container; a torque detection unit that detects torque applied to the rotation member by a waste toner inside the collecting container; and a rotation direction switching unit that switches a rotation direction of the rotation member. When a torque value detected by the torque detection unit is more than a first threshold, the rotation direction of the rotation member is switched by the rotation direction switching unit.

7 Claims, 11 Drawing Sheets

IMAGE FORMING DEVICE

CROSS-REFERENCE TO RELATED APPLICATIONS

The present application claims priority to and incorporates by reference the entire contents of Japanese Patent Application No. 2009-198830 filed in Japan on Aug. 28, 2009.

BACKGROUND OF THE INVENTION

1. Field of the Invention

The present invention relates to an image forming device that collects a waste toner through a waste toner collecting container.

2. Description of the Related Art

An image forming device collects a transfer residual toner on an image carrier from the image carrier through a cleaning device as a waste toner. To this end, the image forming device requires a waste toner collecting container to store the waste toner. A replacement frequency of the waste toner collecting container can decrease (effective utilization of resources) by increasing its capacity. However, as the size of the main body is recently reduced, there is a limit to increasing the capacity. For this reason, the replacement frequency of the waste toner collecting container recently tends to increase. It leads to results opposite to a long lifespan and resource saving demanded from the world. In order to achieve longer lifespan or more resource saving even in the small waste toner collecting container, studies on effective use of a space inside the waste toner collecting container or reduction in the number of components have been conducted.

For example, Japanese Patent Application Laid-open No. 2005-257813 discloses a technique of installing a rotation member in the waste toner collecting container and spreading the waste toner in the waste toner collecting container. A technique of determining whether or not it is full by detecting a rotation of the rotation member is also disclosed.

Further, for example, Japanese Patent No. 3183733 discloses a technique of detecting fullness of the waste toner collecting container by installing the rotation member in a waste toner transport path and detecting a load applied to the rotation member from the waste toner because the waste toner collecting container is full of the waste toner.

However, in the technique disclosed in Japanese Patent Application Laid-open No. 2005-257813, since the rotation member rotates only in one direction, the waste toners may be unevenly stacked on one side of the waste toner collecting container.

Further, in the technique disclosed in Japanese Patent No. 3183733, even when the waste toners are unevenly stacked on one side, it may be determined that the waste toner collecting container is full.

SUMMARY OF THE INVENTION

It is an object of the invention to at least partially solve the problems in the conventional technology.

According to an aspect of the present invention there is provided an image forming device including: a collecting container that collects a waste toner; a rotation member that rotates and spreads a waste toner inside the collecting container; a torque detection unit that detects torque applied to the rotation member by a waste toner inside the collecting container; and a rotation direction switching unit that switches a rotation direction of the rotation member. When a torque value detected by the torque detection unit is more than a first threshold, the rotation direction of the rotation member is switched by the rotation direction switching unit. The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Among image forming devices including a cleaning device that removes a residual toner or a foreign substance such as a paper powder on a photoreceptor, many image forming devices have a configuration of transporting the waste toner removed from the photoreceptor to the waste toner collecting container detachably attached to a main body or an image forming unit by a transport unit disposed in the cleaning device and storing the waste toner.

It is necessary to change a capacity of the waste toner collecting container upon request. However, as the size of the main body recently decreases, it becomes difficult to increase the capacity, and thus the replacement frequency tends to increase. However, since longer lifespan and more resource saving are also required, effective use of a space inside the waste toner collecting container and reduction in the number of components are necessary.

Next, embodiments for implementing the invention will be described with reference to the accompanying drawings.

In a process cartridge disposed in the main body, an untransferred toner collected by the cleaning device is transported by a waste toner transport mechanism and stored in the waste toner collecting container through a waste toner discharge port. A rotation member is disposed in the waste toner collecting container to transport and spread the collected waste toner inside the container. Further, a mechanism for reversely rotating the rotation member is disposed to prevent an uneven stack in the container, so that the space inside the waste toner collecting container can be effectively used.

Figure 1:
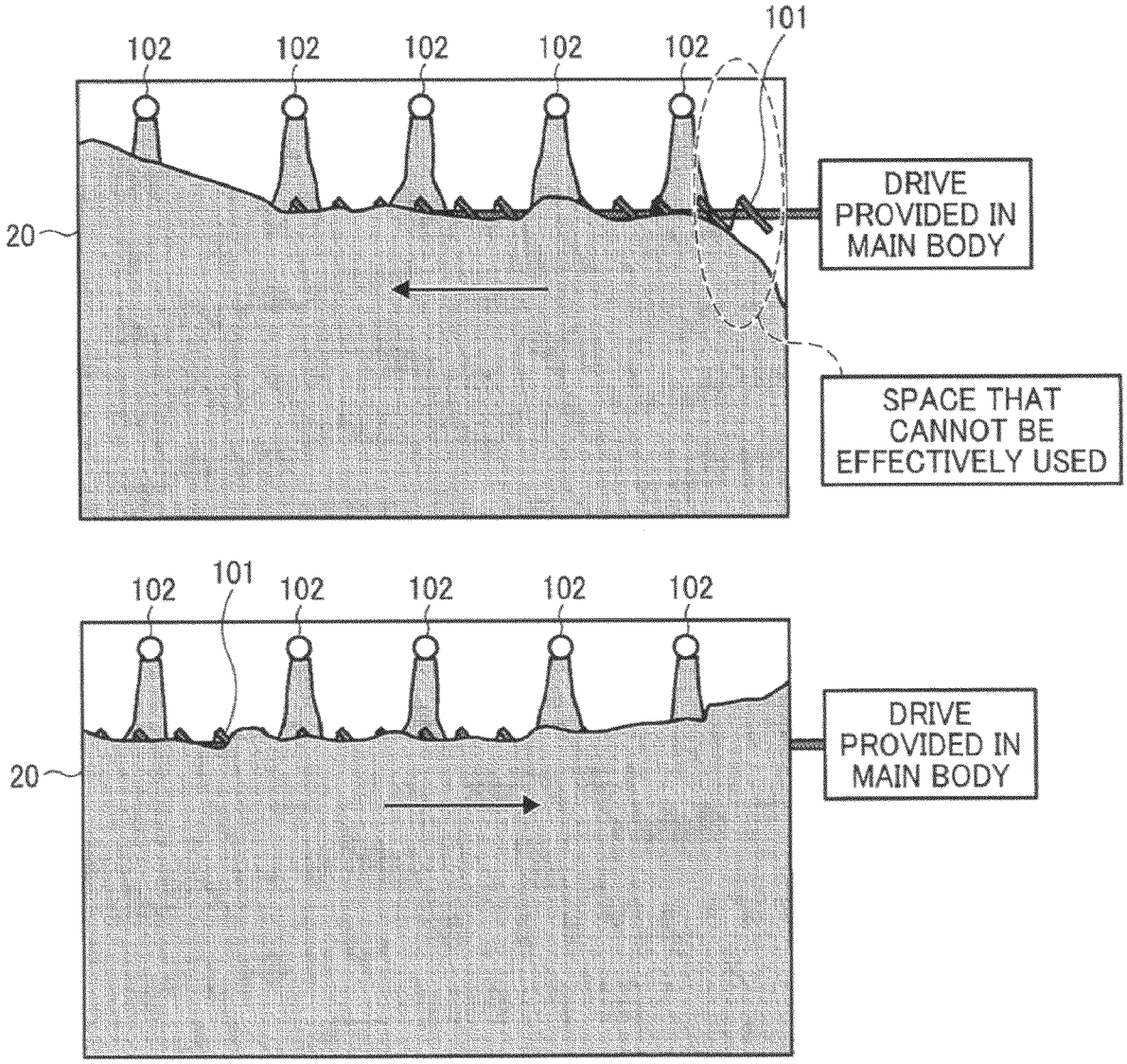
FIG. 1 is a view illustrating a storage state inside a waste toner collecting container of an image forming device according to an embodiment of the invention.

FIG. 1 is a view illustrating a storage state inside a waste toner collecting container and a change of a storage state by a reverse rotation in an image forming device according to an embodiment of the invention. As illustrated in an upper drawing in FIG. 1, when a rotation member 101 rotates only in one direction, an uneven stack may be formed on one side of a waste toner collecting container 20. This generates a position where the space can not be effectively used at an upstream side of the rotation member 101 in a transport direction.

For this reason, in the invention, when a certain amount of stack is detected, the rotation direction of the rotation member 101 is reversed. As a result, as illustrated in a lower drawing in FIG. 1, the waste toner transport direction of the waste toner is reversed by reversing the rotation of the rotation member 101. Therefore, the waste toner unevenly stacked on one side is transported in the reverse direction, so that the waste toner can be filled even in the space of the reverse side that was not effectively used. Accordingly, it is possible to increase the fill quantity inside the waste toner collecting container 20, leading to effective space use.

FIG. 1 illustrates the screw-shaped rotation member 101 that performs transportation in one direction. However, the rotation member 101 with a shape that performs transportation in two or more directions in accordance with a discharge port 102 of the waste toner may be used and the rotation of such rotation member 101 is reversed, so that the storage efficiency of the waste toner collecting container 20 can be improved. Further, the rotation member 101 may have a coil shape.

As illustrated in the upper drawing in FIG. 1, the rotation member 101 rotates with a specific torque value by a driving motor. However, when the waste toners are unevenly stacked on one side, torque applied to the rotation member 101 increases due to the resistance of the waste toners. For this reason, a unit for detecting torque applied to the rotation member 101 is preferably disposed. When a detected torque value is more than a certain threshold, it is determined that the waste toners are unevenly stacked on one side. When it is determined that the waste toners are unevenly stacked on one side, the rotation of the rotation member 101 is switched to the reverse rotation.

For example, when torque applied to the rotation member 101 increases, a torque value of the drive motor should be increased in order to rotate the drive motor at a constant speed. Therefore, for example, a torque value applied to the rotation member 101 is preferably determined or by determining a torque increment of the drive motor based on an electric current value of the drive motor.

By spreading through the rotation member 101, the stack state of the storage material inside the waste toner collecting container 20 can collapse to some extent, but the stack state of the storage material inside the waste toner collecting container 20 becomes uneven depending on a position of a receiving port of the storage material or the rotation direction of the rotation member 101. Therefore, as described above, switching the rotation direction of the rotation member 101 can cause, by switching the rotation direction thereof, the unevenly stacked storage material to be further dispersed in addition to serving as a mechanism for spreading contents inside the waste toner collecting container 20. Accordingly, the collecting efficiency inside the waste toner collecting container 20 can be improved. Further, the threshold of the torque value can be changed by a control unit. This makes it possible to effectively switch the rotation direction base on a value obtained by detecting torque of the rotation member 101. As a result, the waste toners can be more effectively filled in the waste toner collecting container 20 even in a case of the abnormal stack state.

Figure 2:
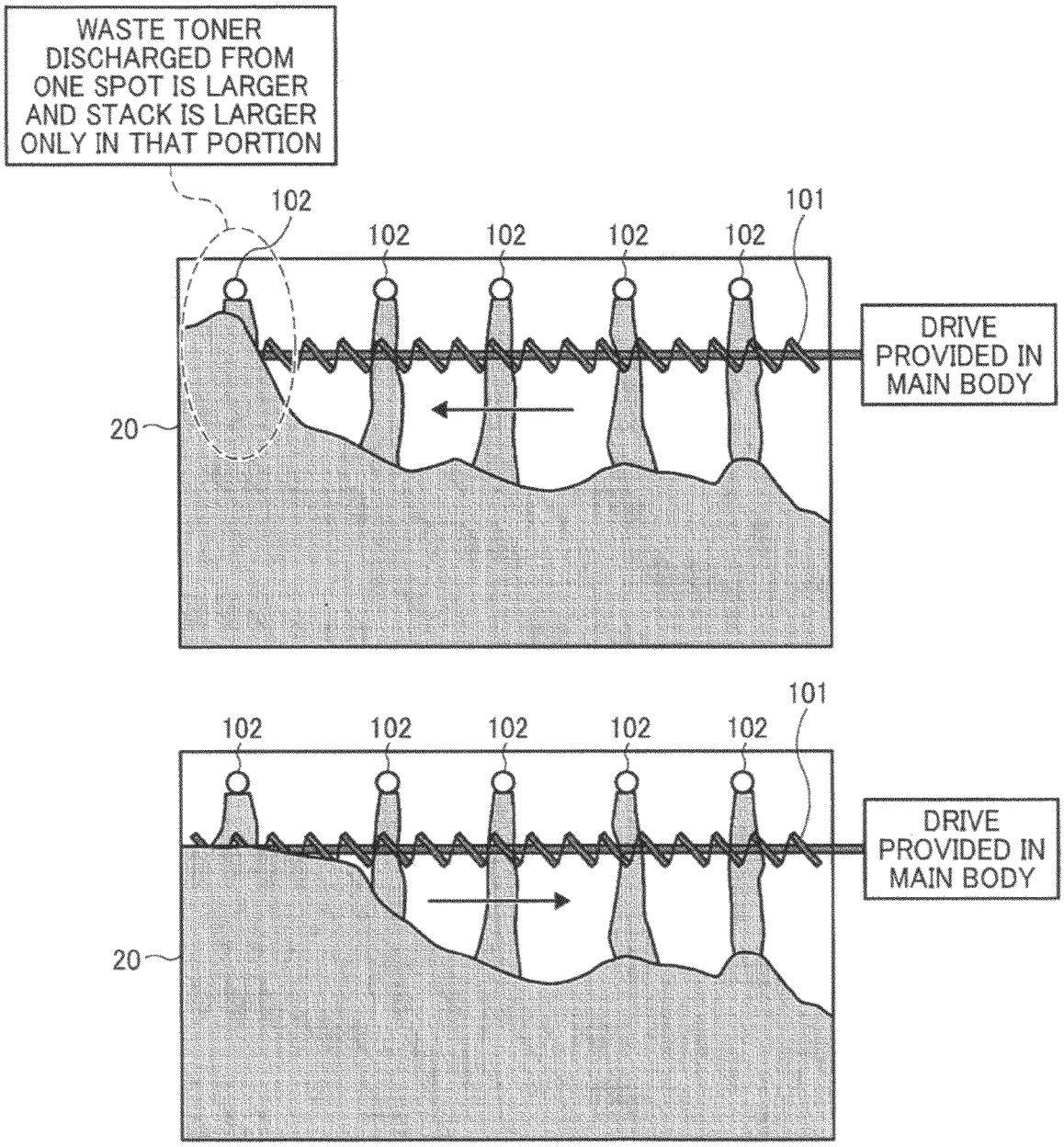
FIG. 2 is a view illustrating a storage state inside a waste toner collecting container of an image forming device according to an embodiment of the invention.

As illustrated in an upper drawing in FIG. 2, when the waste toner is unevenly discharged from the discharge ports 102, it may become a state in which a stack is larger only in one part inside the waste toner collecting container 20. For example, when monochrome printing is performed, the waste toner is discharged only from a black process cartridge. FIG. 2 illustrates a case in which the waste toner discharged from the discharge port 102 on the left end is significantly larger than the waste toner discharged from other discharge ports 102.

In this case, the torque applied to the rotation member 101 is not very large. However, if the unevenness of the waste toners is not handled, the discharge port 102 of the waste toner may be clogged, so that the stacked waste toners reach the discharge port of PCU, etc., causing waste toner clogging in the transport path. Therefore, even in the state illustrated in the upper drawing in FIG. 2, in order to reverse the rotation of the rotation member 101, the torque threshold for rotation direction switching is desired to have a small value.

However, if the torque threshold always has a small value, since the sufficient fill quantity can not be secured, it is difficult to achieve the effectively use of the space that is a primary purpose. For this reason, a unit for controlling a change of the torque threshold is disposed. Thereby, an initial threshold is set small. Thus, it is possible to reverse the rotation direction of the rotation member 101 even when a stack is larger only in one part as illustrated in the upper drawing in FIG. 2. Every time reversing the rotation is repeated, the threshold is sequentially increased. That is, the torque threshold is increased as the fill quantity of the waste toner increases.

Figure 3:
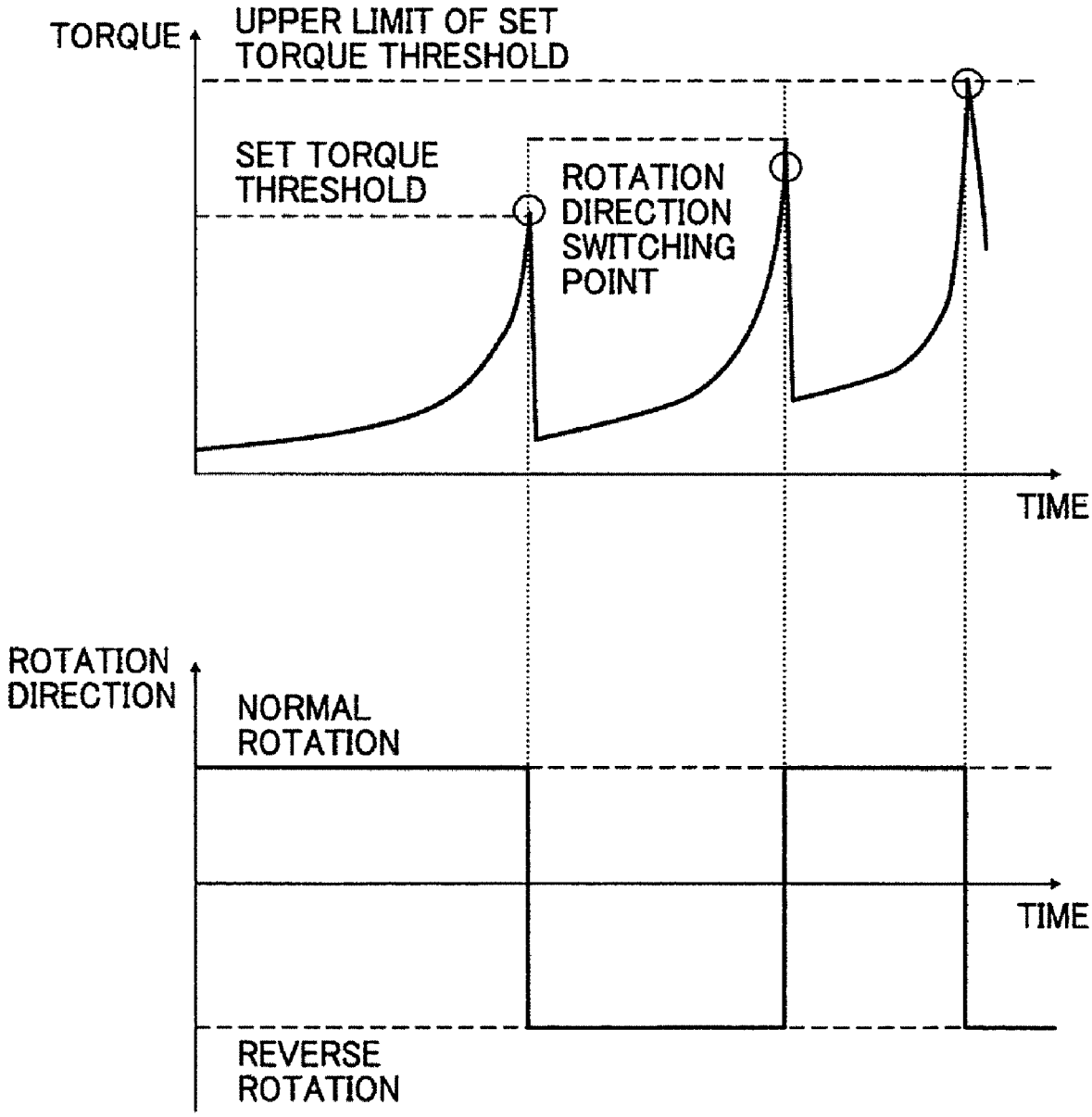
FIG. 3 is a view illustrating a temporal change in torque applied to a rotation member and in a rotation direction of the rotation member in an image forming device according to an embodiment of the invention.

An upper drawing in FIG. 3 is a view illustrating a temporal change in torque applied to the rotation member of the image forming device according to an embodiment of the invention, and a lower drawing in FIG. 3 is a view illustrating a temporal change in a rotation direction of the rotation member of the image forming device according to an embodiment of the invention. As illustrated in the upper drawing in FIG. 3, as time elapses, the fill quantity of the waste toner increases, so that the torque value increases. When the torque exceeds a set threshold, the rotation direction of the rotation member 101 is switched. As illustrated in FIG. 3, the threshold gradually increases and changes up to a threshold set as an upper limit. Every time the rotation direction is switched, the torque threshold is changed, so that the space inside the waste toner collecting container 20 can be more effectively used.

When the waste toner collecting container 20 is new and starts an operation, a stack state such as, particularly, illustrated in the upper drawing in FIG. 2 is likely to occur. For this reason, an initial torque is desired to be set small. Therefore, the initial torque threshold may be set to a value equal to or less than a half of the threshold set as the upper limit.

As described above, since the initial threshold is set small, when filling from the initial operation, even when the abnormal stack is formed in the waste toner collecting container 20 due to the use condition, it can be ensured that an operation of switching a first rotation direction can be performed at an early time, so that effective filling can be performed.

Figure 4:
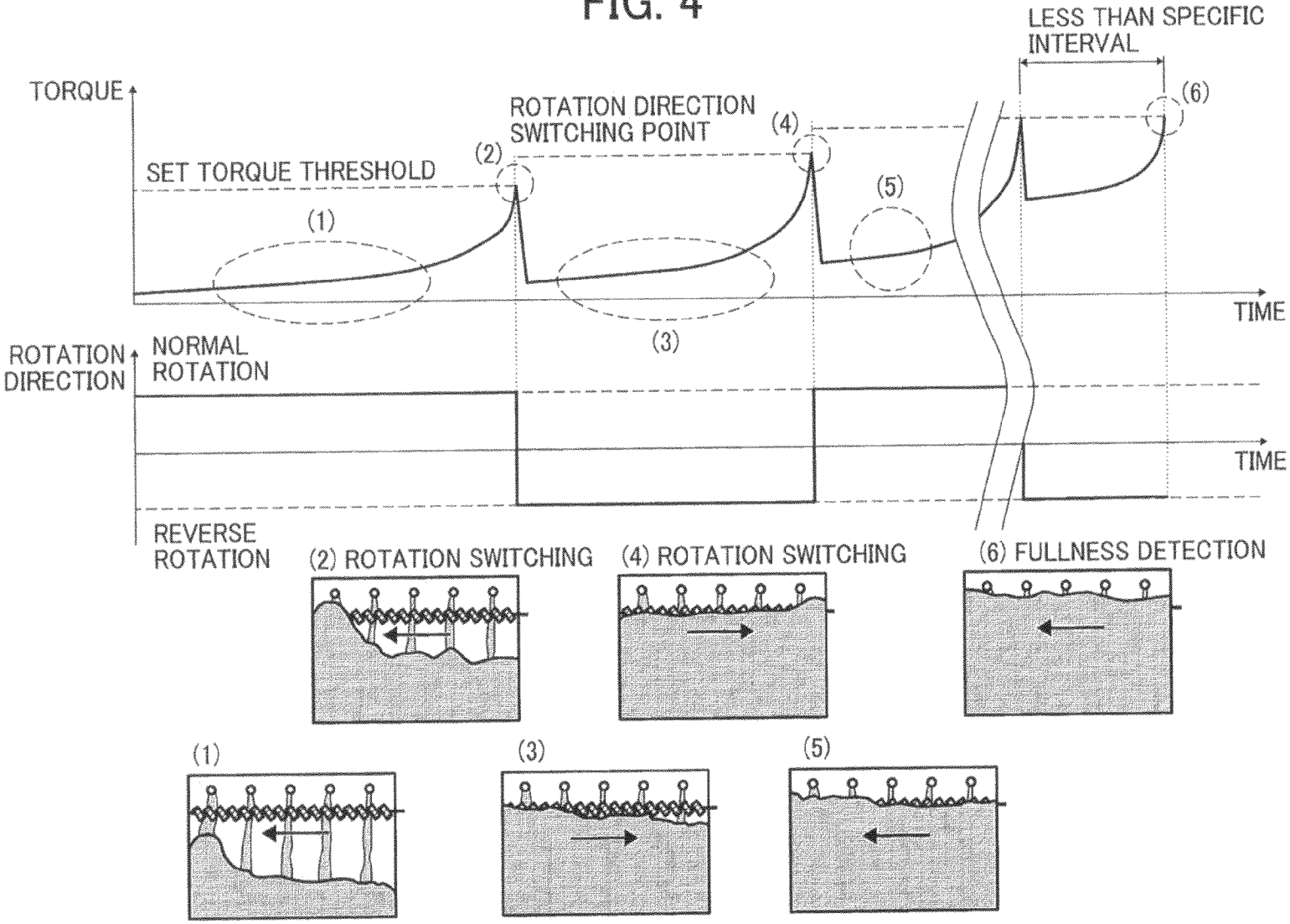
FIG. 4 is a view illustrating a stack state inside a waste toner collecting container when a rotation direction of a rotation member of an image forming device according to an embodiment of the invention is switched.

FIG. 4 is a view illustrating a stack state inside the waste toner collecting container 20 when the rotation direction of the rotation member of the image forming device according to an embodiment of the invention is switched. Since the torque applied to the rotation member 101 is increased according to the stack quantity and the fill quantity of the waste toner, the rotation direction switching operation can be performed by comparing the detected torque with the threshold. If the fill quantity of the waste toner is increased, since the detected torque value is large even when the rotation direction is switched, the rotation direction is switched immediately after the rotation direction is switched.

For this reason, a counting unit for counting a rotation direction switching interval is preferably disposed, and a threshold may be set even to the rotation direction switching interval as a criterion for determining whether or not the rotation direction of the rotation member 101 should be switched. In this case, it may be possible to determine whether or not a full state occurs by comparing an interval counted by the counting unit with an interval threshold.

As described above, the rotation direction switching interval of the rotation member 101 is counted, and fullness detection can be performed based on the value. Accordingly, the number of components of the waste toner collecting container 20 can be reduced, leading to the simple configuration.

Figure 5:
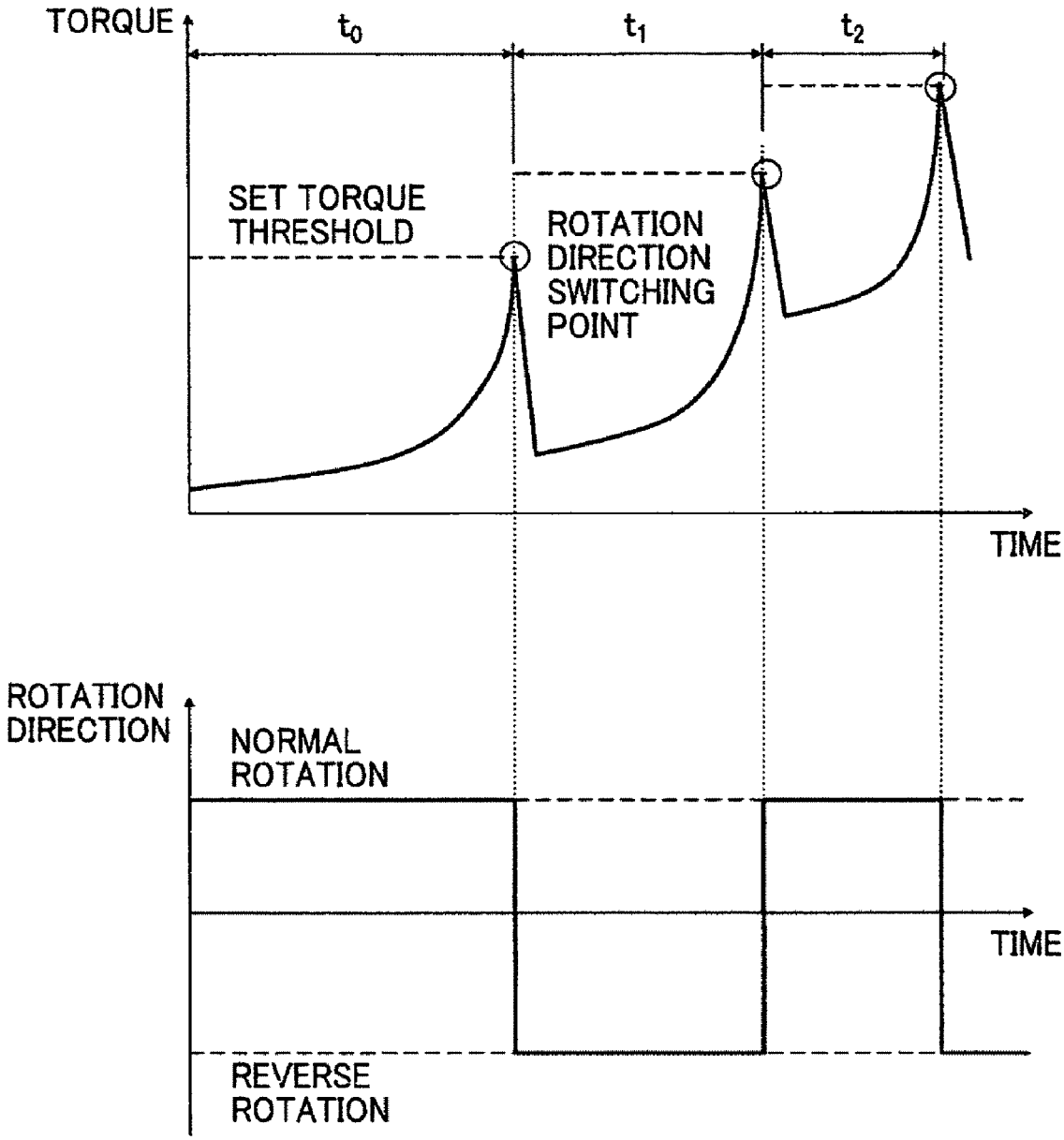
FIG. 5 is a view illustrating a temporal change in a rotation direction switching interval of a rotation member of an image forming device according to an embodiment of the invention.

FIG. 5 is a view illustrating that the rotation direction switching interval changes as the fill quantity of the waste toner increases. As illustrated in an upper drawing in FIG. 5, since the waste toner is increasingly filled in the waste toner collecting container 20 with the lapse of time, the time interval until the rotation is reversed is gradually shortened. When the waste toner storage quantity inside the waste toner collecting container 20 almost reaches the full state, even though the stack quantity on one side is large and so the rotation is reversed, since the stack quantity on the other side is also large, the rotation direction is switched immediately. For this reason, a switching time $T_0$ for determining the full state is set. When a time $t_n$ until the rotation is reversed (at the time of image formation) is smaller than a set time $T_t$ ($t_n<T_t$), it is determined that the waste toner collecting container 20 is full of the waste toner.

As a result, it is possible to detect the full state using a mechanism for reversing the rotation of the rotation member 101. Regarding a counted time, a measured time is not limited and may be an operation time of the image forming device, a rotation time of the image carrier, etc. In a similar manner, a nearly full state as well as the full state can be detected.

Figure 6:
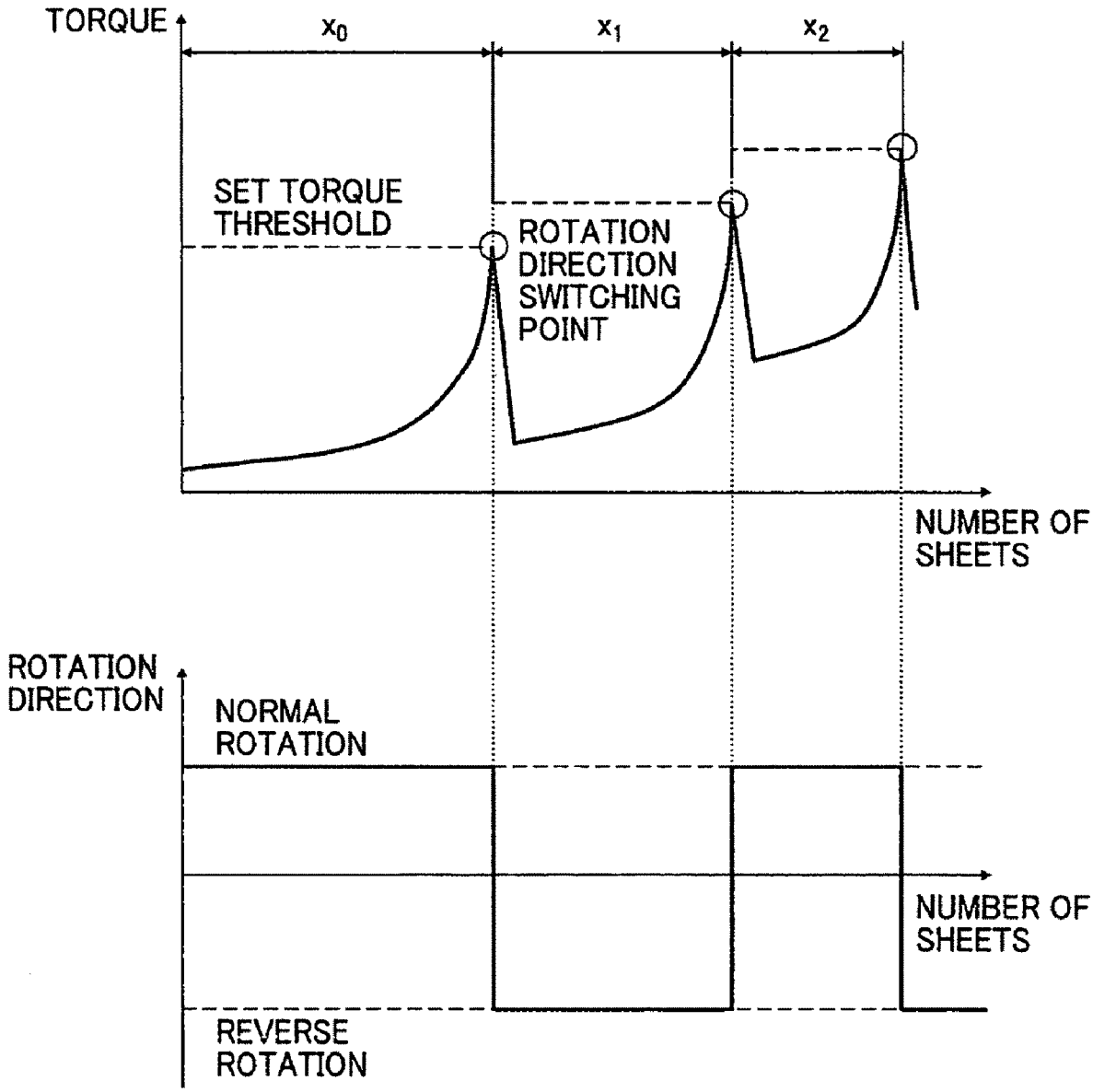
FIG. 6 is a view illustrating a temporal change in the number of sheets printed until a rotation direction of a rotation member of an image forming device according to an embodiment of the invention is switched.

As the accumulated number of printed sheets increases, the waste toner is increasingly stored in the waste toner collecting container 20. That is, since the waste toner is increasingly filled in the waste toner collecting container 20, the interval until the rotation is reversed is gradually shortened. Likewise, as the accumulated number of the printed sheets increases, the number of printed sheets until the rotation is reversed is gradually decreased. FIG. 6 is a view illustrating that the number of printed sheets until the rotation is reversed gradually decreases as the accumulated number of printed sheets increases. When the waste toner storage quantity inside the waste toner collecting container 20 is close to the full state, even when the stack quantity on one side is large and so the rotation is reversed, since the stack quantity on the other side is also large, the rotation direction is switched immediately. For this reason, a number of printed sheets $X_t$ until the rotation is reversed, which is used to determine the full state, is set. When a number of printed sheets $x_n$ until the rotation is reversed is smaller than the set number of printed sheets $X_t$ ($x_n<X_t$), it is determined that the waste toner collecting container 20 is full of the waste toner.

As a result, it is possible to detect the full state using a mechanism for reversing the rotation of the rotation member 101. In a similar manner, a nearly full state as well as the full state can be detected.

The rotation member 101 inside the waste toner collecting container 20 should be connected to the main body of the image forming device at the time of setting in order to obtain driving power from the main body of the image forming device. By detecting torque after the rotation member 101 was connected with a driving unit, it is possible to detect that the waste toner collecting container 20 was set to the main body. That is, setting detection of the waste toner collecting container 20 to the main body can be performed. To this end, the torque detection unit can also perform the setting detection, and thus it is not necessary to perform setting detection to the main body through a separate mechanism. Accordingly, the number of components can be reduced.

In the invention, every time the rotation direction is reversed, the threshold of the torque is changed. If detection of the replacement with a new one is not performed after the waste toner collecting container 20 was replaced, even after the waste toner collecting container 20 is replaced, the torque threshold remains large. In this case, when the torque threshold reaches an upper limit value once, the threshold does not fall from that value. For this reason, it is necessary to perform detection of the replacement with a new one and lower the torque threshold once after replaced with a new one.

Figure 7:
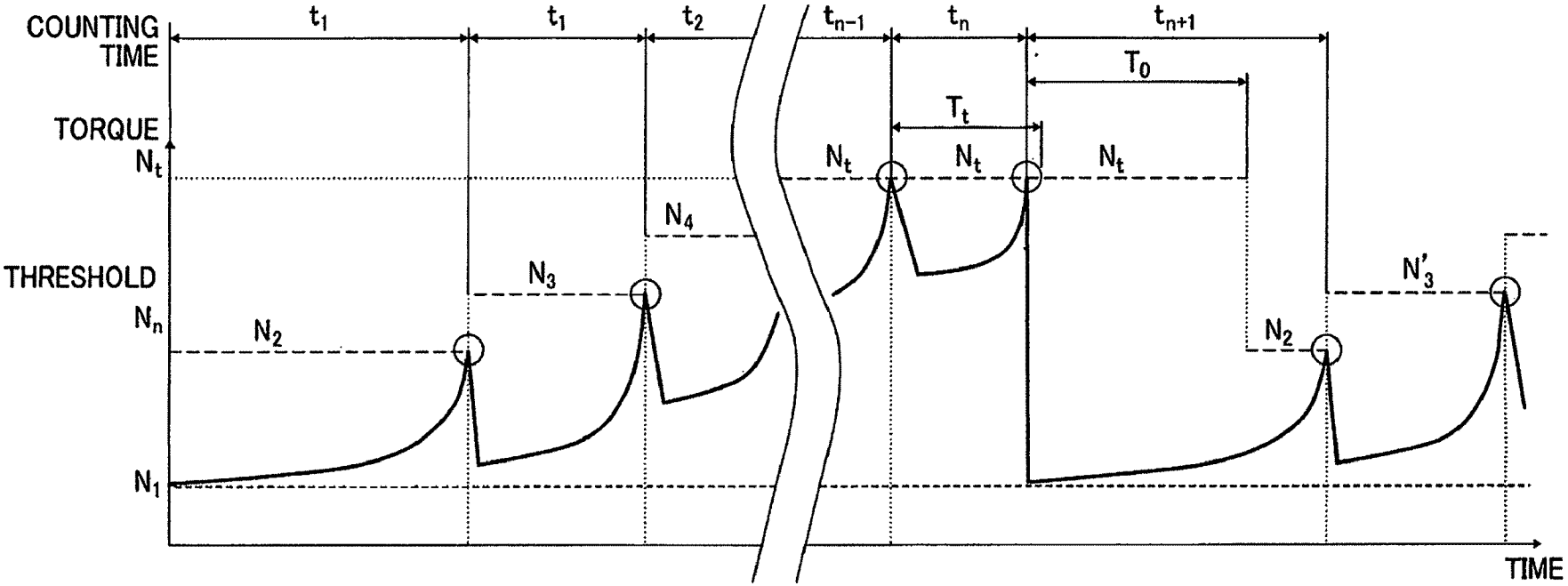
FIG. 7 is a view for explaining a method of detecting that a waste toner collecting container is replaced with a new one in an image forming device according to an embodiment of the invention.

FIG. 7 is a view for explaining a method of detection of the replacement with a new one through the torque detection unit and the counting unit. Similarly to the full state detection operation, a fixed value for detection of the replacement with a new one is set. Here, as the fixed value, $T_0$ is set when based on time, and $X_0$ is set when based on a number of printed sheets. FIG. 7 illustrates the fixed value when based on time. Since the rotation direction switching interval is counted by the counting unit, if the counted value is larger than the fixed value for detection of the replacement with a new one ($t_n>T_0$, $x_n>X_0$), it is determined that the waste toner collecting container 20 was replaced with a new one, and the threshold of the torque is changed to be set small by a control unit. That is, when the waste toner collecting container 20 is replaced with a new one, the threshold of the torque is reset to an initial value. However, when the threshold of the torque is not an upper limit value ($N_n<N_t$), even though the counted value by the counting unit is larger than the fixed value for detection of the replacement with a new one (a time $t_n>T_0$ and a number $x_n>X_0$), it is not determined that it was replaced with a new one.

The torque threshold $N_n$ is gradually changed to a high set value by the control unit and finally reaches an upper limit threshold $N_t$. The rotation direction switching interval is counted by the counting unit. In the drawing, a time $t_n$ is counted. If the time t is shorter than the fixed value of the full state ($t_n<T_n$ in the drawing), it is determined that the waste toner collecting container 20 is full, and a state in which a copy operation is inhibited is set. If the time t is longer than the fixed value for detection of the replacement with a new one ($t_{n+1}>T_0$ in the drawing), it is determined that the waste toner collecting container 20 was replaced with a new one, and the torque threshold is changed to a small value by the control unit.

Figure 8:
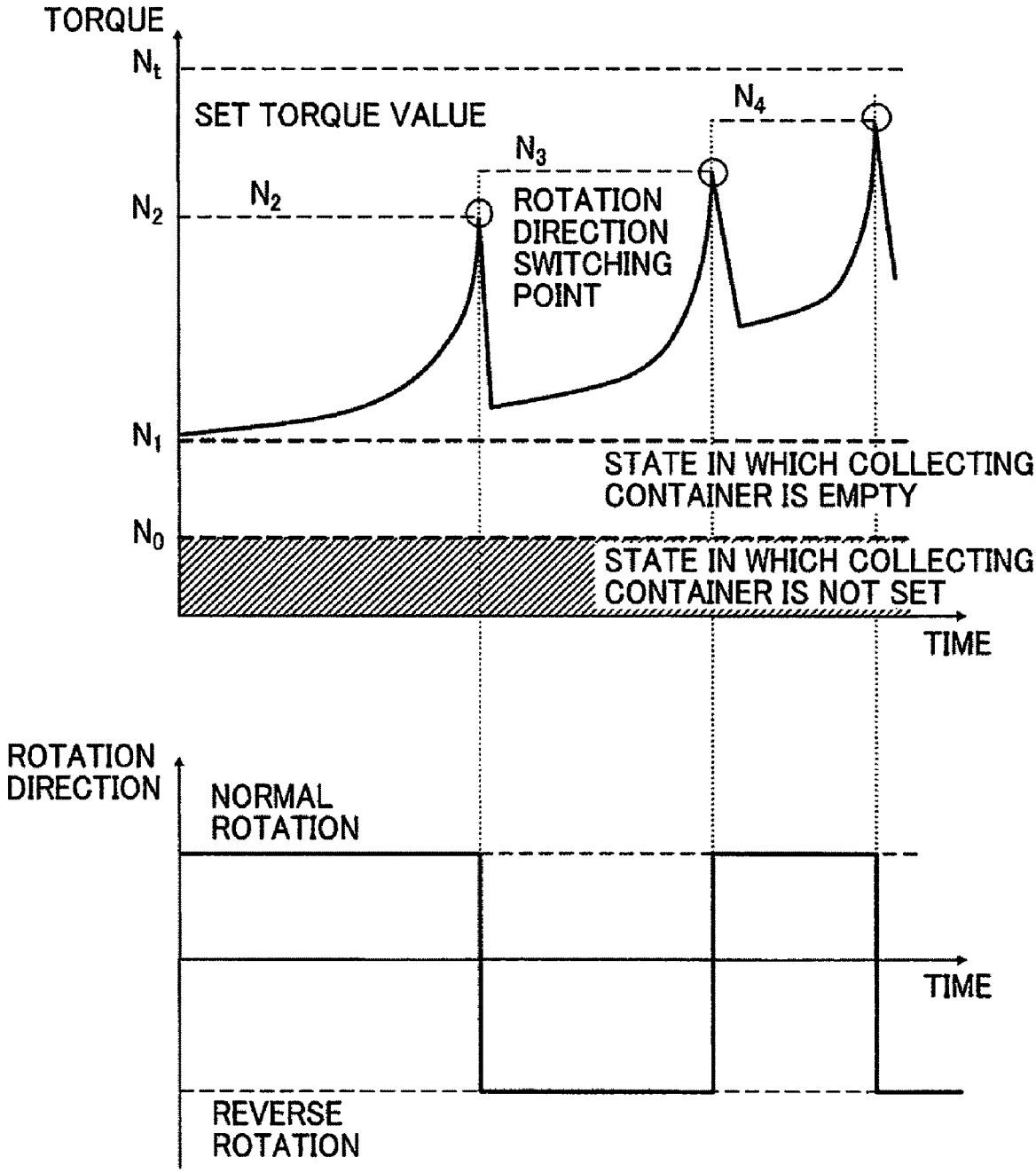
FIG. 8 is a view for explaining a method of detecting that a waste toner collecting container is set in an image forming device according to an embodiment of the invention.

FIG. 8 illustrates setting detection of the waste toner collecting container 20 through torque detection.

(i) Non-setting state of the waste toner collecting container 20 (in FIG. 8, torque N is $N \leqq N_0$)

In a state in which there is no waste toner collecting container 20 or a state in which the rotation member 101 is not normally connected with the driving unit of the main body, the torque applied to the driving unit is nearly zero (0). Therefore, it is determined as a setting failure of the waste toner collecting container 20, and the copy operation is inhibited.

(ii) Setting state of the waste toner collecting container 20 (in FIG. 8, torque N is $N > N_0$)

Since the rotation member 101 is normally connected with the driving unit of the main body, even when the torque is small because the waste toner collecting container 20 is new, the torque is larger than in the non-setting state ($N_1 > N_0$). It is determined that the waste toner collecting container 20 is in the setting state, and so the copy operation is permitted.

Further, $N_1$ is set as torque when the waste toner collecting container 20 is set in an empty state, $N_n$(n: 2 to t) is set as a torque threshold when the rotation direction is switched, $N_t$ is set as a fixed value of an upper limit of a torque threshold, and $N_0(<N_1)$ is set as torque that is smaller than when the waste toner collecting container 20 is in the empty state. By these setting, when the torque N is $N \leqq N_0$, it can be determined as the non-setting state, while when $N > N_0$, it can be determined as the normal state. When $N > N_n$, it can be determined as a state after (n−1)th switching of the rotation direction of the rotation member 101 to reverse the rotation was performed.

The rotation member 101 may have various shapes such as (1) a shape in which the transport direction is reversed at a center (2) a shape in which the transport direction is reversed at a position near an end, or (3) a shape in which transport directions are different at two parts (transportation to a center is performed at a central part, and transportation to each end is performed at each end part). In these shape or other shapes, the above-described effects can be obtained by reversing the rotation.

Figure 9:
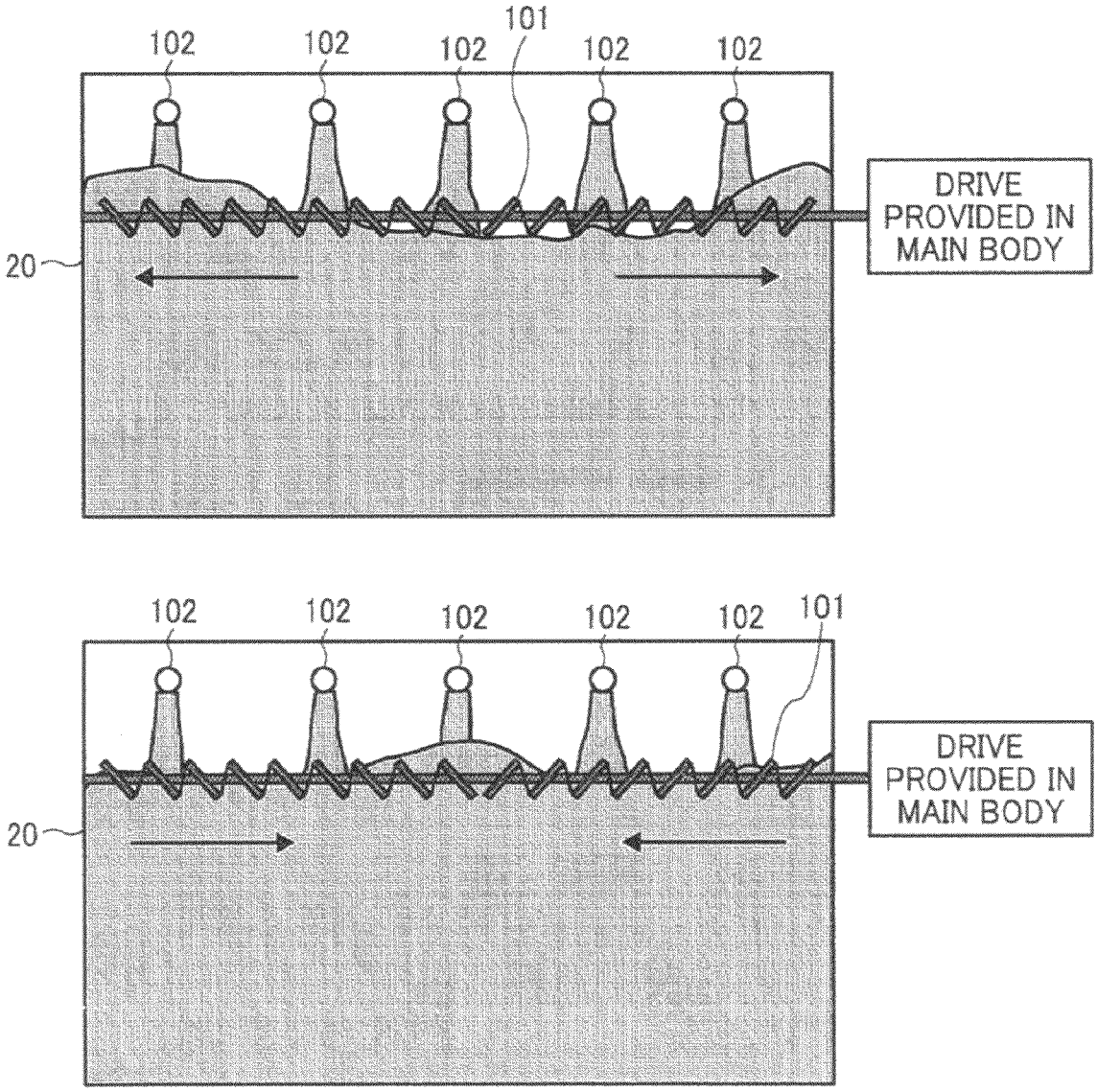
FIG. 9 is a view illustrating a rotation member of an image forming device according to an embodiment of the invention.

FIG. 9 is a view illustrating a case where the rotation member 101 has (1) the shape in which the transport direction is reversed at the center. The waste toner is transported to both ends and starts to be stacked at both end parts. A stack in a central part is smaller than that in the both end parts. By reversing the rotation direction of the rotation member 101, stacks in both end parts can collapse, so that a stack is equally formed even in the central part.

Figure 10:
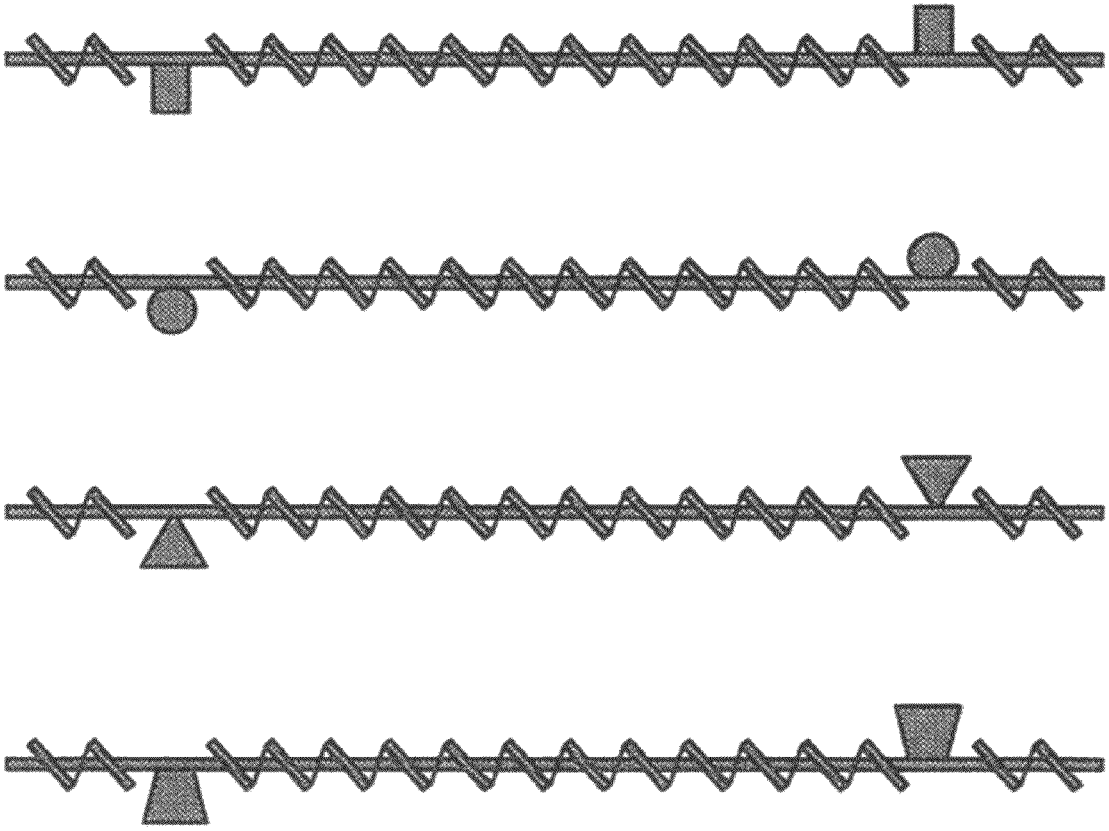
FIG. 10 is a view illustrating a rotation member of an image forming device according to an embodiment of the invention.

By forming plane parts at both end parts of the rotation member 101, the ability for spreading the waste toner stacked in the waste toner collecting container 20 is enhanced. Since an area of resistance increases in a state in which the waste toner has been stacked and the torque totally has a large value, difference in a torque value depending on the fill quantity of the waste toner increases. For this reason, it is possible to improve the accuracy for performing an operation of switching the rotation direction based on torque detection. FIG. 10 is a view illustrating the rotation member 101 having plane parts formed at both end parts. A shape of the plane parts attached at the end parts is not limited and may have a circular shape or a triangular shape as illustrated in FIG. 10. Further, the size of the surface (the width, the height, and the thickness) is not limited. FIG. 10 illustrates the shape in which the plane parts is attached at the end parts, but in a shape in which the transport direction of the rotation member 101 is changed, a position in a longitudinal direction at which the plane parts are attached is set to conform with the shape.

Figure 11:
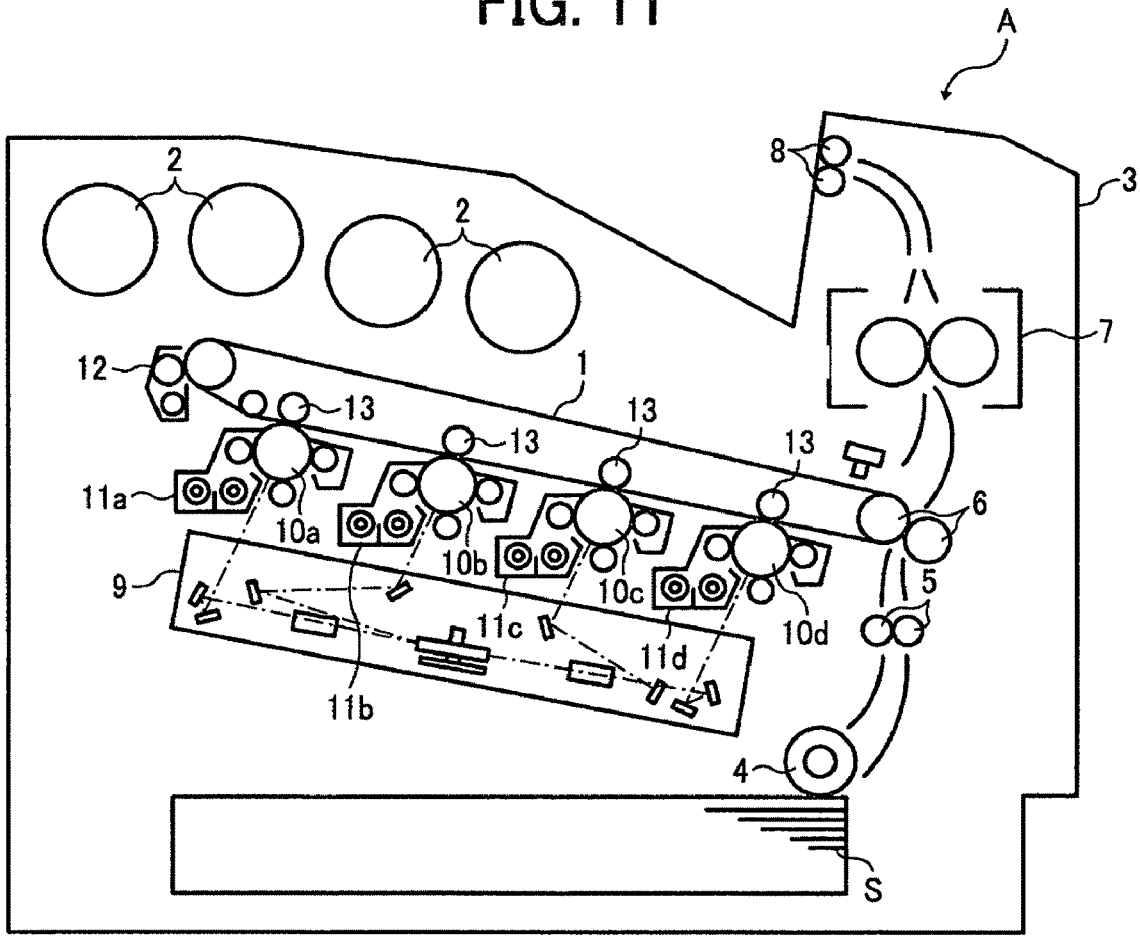
FIG. 11 is a view illustrating a configuration of an image forming device according to an embodiment of the invention.

FIG. 11 is a view illustrating an overall configuration diagram of an image forming device according to an embodiment of the invention. An image forming device A includes an intermediate transfer belt 1 on which a color toner image composed of a plurality of colors for a color image is formed and toner bottles 2 each of which feeds each color toner for the toner image. The intermediate transfer belt 1 and the toner bottles 2 are housed inside an image forming device main body 3. A transferred sheet S stacked and stored below the image forming device main body 3 comes in contact with the intermediate transfer belt 1, so that a color toner image is transferred, and further the color toner image is fixed, and then the transferred sheet S is discharged from an upper portion. That is, roughly from a lower portion to the upper portion of the image forming device A, disposed are a paper feed roller 4 that feeds one piece of the transferred sheet S, a resist roller 5 that controls a transport timing for toner image transfer, a secondary transfer roller 6 disposed to face and contact the intermediate transfer belt 1 and forming a nip in which a predetermined pressure is secured between itself and the intermediate transfer belt 1, a fixing unit 7 that performs heating and pressurization, and a paper discharge roller 8 that discharges the transferred sheet S to the outside of the device. In the process of transporting the transferred sheet S in the transport path formed by these rollers, the toner image is sequentially transferred by the nip from the intermediate transfer belt 1, and the transferred toner image is fixed onto the transferred sheet S by the fixing unit 7.

That is, as four image stations that are assigned respective colors for color image formation and form toner images of the colors, process cartridges 11*a* to 11*d* are disposed in a longitudinal direction of the intermediate transfer belt 1 obliquely disposed so that its left side is elevated in the drawing. The image stations comprising the process cartridges 11*a* to 11*d* have drum-shaped photosensitive elements 10*a*, 10*b*, 10*c*, and 10*d* as image carriers, respectively. The photosensitive elements 10*a* to 10*d* contacts transfer rollers 13 and 13 via the intermediate transfer belt 1 with a predetermined pressure. Dedicated charging units 15*a*, 15*b*, 15*c*, and 15*d*, developing devices 16*a*, 16*b*, 16*c*, and 16*d* as developing units, and cleaning units 14*a*, 14*b*, 14*c*, and 14*d* are disposed around the photosensitive elements 10*a* to 10*d*, respectively. Below the process cartridges 11*a* to 11*d*, a writing unit 9 that exposes the photosensitive elements 10*a* to 10*d* with a laser beam and writes an electrostatic latent image is disposed. A cleaning unit 12 performs cleaning by collecting a residual toner on the intermediate transfer belt 1.

The process cartridge is not limited to the above-described configuration and is preferably integrally constituted with at least one of the charging unit, the developing unit, and the cleansing unit and the electrophotographic photoreceptor (the photosensitive element) as the image carrier, and this configuration is preferably detachably attached to the device main body.

A plurality of toner bottles 2 that feed the toner to the image forming device A is sequentially disposed from the left to the right in the drawing in an upper portion inside the device and is disposed to be detachably attached to the image forming device A for replacement. Toners of yellow, cyan, magenta, and black are filled in the toner bottles 2, respectively. The toner bottles 2 are connected to be able to feed toners to the developing devices 16*a* to 16*d* of respective colors corresponding to the respective toner bottles 2 through a transport path (not shown) and toners of respective colors are fed by a predetermined feed quantity.

Therefore, in the image forming device A configured as described above, when the transferred sheet S is fed by the paper feed roller 4 and so its front end reaches the resist roller 5, the front end of the transferred sheet S is detected by a sensor (not shown). While a timing is synchronized based on this detection signal, the transferred sheet S is transported to the nip formed by the secondary transfer roller 6 and the intermediate transfer belt 1 through the resist roller 5, and the image formed on the intermediate transfer belt 1 is secondarily transferred on the transferred sheet S from the intermediate transfer belt 1.

That is, the photosensitive elements 10*a* to 10*d* are uniformly charged by charging rollers 15*a* to 15*d* in advance and then exposed to the laser beam by the writing unit 9, so that electrostatic latent images are created on the photosensitive elements 10*a* to 10*d*. The respective electrostatic latent images are developed by the developing devices 16*a* to 16*d* of respective colors, so that toner images of yellow, cyan, magenta, and black are formed on surfaces of the photosensitive elements 10*a* to 10*d*. Next, a voltage is applied to the transfer roller 13, and the toners on the respective photosensitive elements 10 are sequentially transferred onto the intermediate transfer belt 1. At this time, image creating operations of respective colors are performed at shifted timings from an upstream side to a downstream side in a feeding direction of the intermediate transfer belt 1 so that the toner images can be transferred on the same position on the intermediate transfer belt 1 in a superimposed manner. The toner images formed on the intermediate transfer belt 1 are transported up to a position of the secondary transfer roller 6 and secondarily transferred on the transferred sheet S. The transferred sheet S onto which color toner images of respective colors are transferred are transported to the fixing unit 7, the toner images are thermally fixed onto the transferred sheet S, and the transferred sheet S is discharged by the paper discharge roller 8.

The waste toners generated by such an image forming operation are cleaned, collected, and discharged from a process cartridge 11. That is, the residual toners on the photosensitive elements 10*a* to 10*d* are removed by the cleaning units 14*a* to 14*d* as the cleaning means and collected as the waste toners, so that the photosensitive elements 10*a* to 10*d* are cleaned. The residual toners remaining on the intermediate transfer belt 1 without being transferred onto the transferred sheet S are similarly removed by the cleaning unit 12 and collected as the waste toners, so that the surface of the intermediate transfer belt 1 is cleaned.

Figure 12:
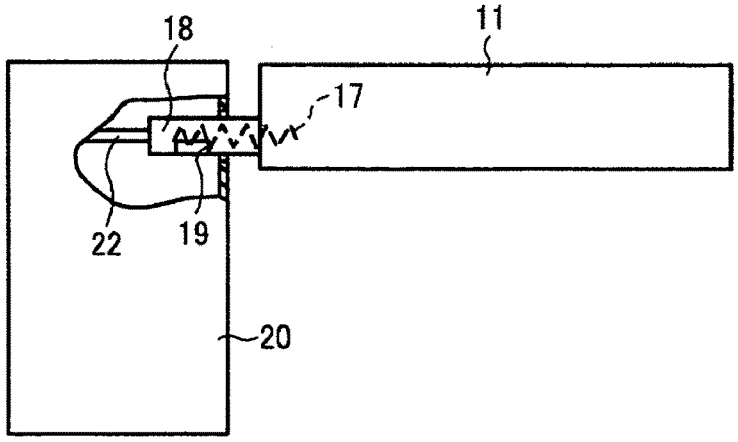
FIG. 12 is a view illustrating a configuration around a waste toner collecting container of an image forming device according to an embodiment of the invention.

As illustrated in FIG. 12, the collected waste toners C are discharged to the waste toner collecting container 20 disposed in the image forming device A from the process cartridge 11 through a waste toner discharge pipe 18. That is, the hollow waste toner discharge pipe 18 that protrudes laterally from the process cartridge 11 is disposed in the process cartridge 11. At a position corresponding to the waste toner discharge pipe 18, that is, a position on the image forming device A corresponding to a setting position of the process cartridge 11, the waste toner collecting container 20 is disposed as a container that secures a predetermined internal capacity in advance. Therefore, when the process cartridge 11 is set to the image forming device A, the front end of the waste toner discharge pipe 18 is fitted into the waste toner collecting container 20.

Further, each cleaning unit 14 has a waste toner transport screw 17 thereinside. The waste toner is transported toward a front end side of the waste toner discharge pipe 18 by the waste toner transport screw 17 and discharged to the inside of the waste toner collecting container 20 through a waste toner discharge port 19 formed at the front end side of the waste toner discharge port 18. That is, the waste toner transport screw 17 is a spiral member such as a coil spring and coaxially disposed inside the waste toner discharge pipe 18 along a longitudinal direction thereof. Further, the waste toner transport screw 17 is disposed such that one end comes in contact with the waste toner collected inside the cleaning unit 14, and the other end faces the waste toner discharge port 19. The waste toner transport screw 17 is rotatively driven in a direction that a spiral moves to the waste toner discharge port 19 side by a driving mechanism (not shown). Therefore, the transport path in which the waste toner is transported is formed from the cleaning unit 14 to the front end of the waste toner discharge pipe 18 by the waste toner transport screw 17 that is rotatively driven as described above.

Further, some image forming devices have a configuration in which the waste toner is not discharged directly from the process cartridge 11 to the waste toner collecting container 20, but the waste toner is discharged to the waste toner transport path formed inside the image forming device main body 3 and then transported from the waste toner transport path to the waste toner collecting container 20. Therefore, in this configuration, since the waste toner transport path is formed between the process cartridge 11 and the waste toner collecting container 20, the waste toner collecting container 20 does not need to be disposed near the process cartridge 11, thereby improving the degree of flexibility in the arrangement of the members inside the device. Meanwhile, a configuration in which the waste toner collecting container 20 is not disposed for each of the process cartridges 11 of respective colors but only one waste toner collecting container 20 is disposed for all of the process cartridges 11 is possible.

The transfer device of the image forming device according to an embodiment of the invention may employ an intermediate transfer technique or a direct transfer technique. The image forming device according to an embodiment of the invention may be a monochrome machine or a color machine.

The waste toner collecting container has been described above, but a container that collects other materials such as a waste developer may have a similar configuration.

Further, a number of waste toner discharge ports 102 is arbitrary. Therefore, the effects of the invention can be achieved even in a configuration having a transport device that collectively transports the waste toners from a plurality of cleaning devices. Further, the effect of the invention can be achieved even in a configuration of collecting a waste developer by a developer automatic exchange method. Moreover, the effect of the invention can be achieved even in a configuration of collecting the waste toner of transfer (both the intermediate transfer and the direct transfer) by a similar mechanism.

The exemplary embodiments of the invention have been described above. Here, the invention has been described in connection with special embodiments, but various modifications or changes may be made to the exemplary embodiments without departing from the spirit and scope of the invention set forth in the appended claims.

Further, in the image forming device of the invention, a lower limit value and an upper limit value may are provided for the first threshold. An initial value may be set to the lower limit value, and every time the rotation direction is switched by the rotation direction switching unit, the first threshold may stepwise increase up to the upper limit value.

Further, in the image forming device of the invention, the lower limit value of the first threshold may be set so as to be smaller than a half of the upper limit value of the first threshold.

Further, the image forming device of the invention may have a time interval counting unit that counts a time interval until the rotation direction of the rotation member is switched. When the time interval counted by the time interval counting unit is smaller than a second threshold, it may be determined that the collecting container is full of the waste toner.

Further, in the image forming device of the invention, when the time interval counted by the time interval counting unit is larger than a third threshold, it may be determined that the collecting container was replaced with a new collecting container.

Further, the image forming device of the invention may have a printed sheet-number counting unit that counts the number of sheets printed until the rotation direction of the rotation member is switched. When the number of sheets counted by the printed sheet-number counting unit is smaller than a fourth threshold, it may be determined that the collecting container is full of the waste toner.

Further, in the image forming device of the invention, when the number of sheets counted by the printed sheet-number counting unit is larger than a fifth threshold, it may be determined that the collecting container was replaced with a new collecting container.

Further, in the image forming device of the invention, when a torque value detected by the torque detection unit is increased from a value less than a sixth threshold to a value more than the sixth threshold, it may be determined that the collecting container was set.

According to the invention, it is possible to effectively use the space inside the waste toner collecting container.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming device, comprising:

a collecting container that collects a waste toner;

a rotation member that rotates and spreads a waste toner inside the collecting container;

a torque detection unit that detects torque applied to the rotation member by a waste toner inside the collecting container; and a rotation direction switching unit that switches a rotation direction of the rotation member, wherein when a torque value detected by the torque detection unit is more than a first threshold, the rotation direction of the rotation member is switched by the rotation direction switching unit, and a lower limit value and an upper limit value are provided for the first threshold, the first threshold is initially set to the lower limit value and stepwise increases up to the upper limit value every time the rotation direction is switched by the rotation direction switching unit.

2. The image forming device according to claim 1, wherein the lower limit value of the first threshold is equal to or less than a half of the upper limit value of the first threshold.

3. The image forming device according to claim 1, further comprising:

a time interval counting unit that counts a time interval until the rotation direction of the rotation member is switched, wherein when the time interval counted by the time interval counting unit is smaller than a second threshold, it is determined that the collecting container is full of the waste toner.

4. The image forming device according to claim 3, wherein when the time interval counted by the time interval counting unit is larger than a third threshold, it is determined that the collecting container was replaced with a new one.

5. The image forming device according to claim 1, further comprising:

a printed sheet-number counting unit that counts the number of sheets printed until the rotation direction of the rotation member is switched, wherein the number of sheets counted by the printed sheet-number counting unit is smaller than a fourth threshold, it is determined that the collecting container is full of the waste toner.

6. The image forming device according to claim 5, wherein when the number of sheets counted by the printed sheet-number counting unit is larger than a fifth threshold, it is determined that the collecting container was replaced with a new one.

7. The image forming device according to claim 1, wherein when a torque value detected by the torque detection unit increases from a value less than a sixth threshold to a value more than the sixth threshold, it is determined that the collecting container was set to a main body of the image forming device.

* * * * *